US010598024B2

(12) United States Patent
Forcier et al.

(10) Patent No.: US 10,598,024 B2
(45) Date of Patent: Mar. 24, 2020

(54) TANDEM ROTOR BLADES

(71) Applicant: United Technologies Corporation, Farmington, CT (US)

(72) Inventors: Matthew P. Forcier, South Windsor, CT (US); Brian J. Schuler, West Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 18 days.

(21) Appl. No.: 14/882,722

(22) Filed: Oct. 14, 2015

(65) Prior Publication Data

US 2016/0108735 A1 Apr. 21, 2016

Related U.S. Application Data

(60) Provisional application No. 62/064,536, filed on Oct. 16, 2014.

(51) Int. Cl.

| | |
|---|---|
| ***F01D 5/14*** | (2006.01) |
| ***F04D 29/32*** | (2006.01) |
| ***F01D 9/04*** | (2006.01) |
| ***F01D 11/00*** | (2006.01) |
| ***F04D 29/54*** | (2006.01) |
| ***F04D 19/02*** | (2006.01) |

(52) U.S. Cl.

CPC ..... *F01D 5/146* (2013.01); *F01D 9/041* (2013.01); *F01D 11/001* (2013.01);

(Continued)

(58) Field of Classification Search

CPC ..... F01D 5/146; F01D 11/001; F01D 9/041; F01D 1/04; F01D 1/10; F01D 1/20;

(Continued)

(56) References Cited

U.S. PATENT DOCUMENTS 2,435,236 A * 2/1948 Redding ..... F04D 21/00 415/181
2,446,552 A * 8/1948 Redding ..... F04D 17/025 415/194

(Continued)

FOREIGN PATENT DOCUMENTS

EP 0043452 A2 1/1982
EP 1077310 A1 * 2/2001 ..... F01D 5/141
GB 2176251 A 12/1986

OTHER PUBLICATIONS

English machine translation of EP 1 077 310, Feb. 2001.*

(Continued)

*Primary Examiner* — Christopher Verdier
(74) *Attorney, Agent, or Firm* — Cantor Colburn LLP

(57) ABSTRACT

A gas turbine engine includes a compressor section and a compressor case with a low pressure compressor (LPC) and a high pressure compressor (HPC). The HPC is aft of the LPC. The compressor case defines a centerline axis. The compressor section also includes a rotor disk defined between the compressor case and the centerline axis. A plurality of stages are defined radially inward relative to the compressor case. The plurality of stages include at least one tandem blade stage. The tandem blade stage includes a plurality of blade pairs. Each blade pair is circumferentially spaced apart from the other blade pairs, and is operatively connected to the rotor disk. Each blade pair includes a forward blade and an aft blade. The aft blade is configured to further condition air flow with respect to the forward blade without an intervening stator vane stage shrouded cavity therebetween.

14 Claims, 4 Drawing Sheets

(52) U.S. Cl.
CPC ..... *F04D 29/324* (2013.01); *F04D 19/02* (2013.01); *F04D 29/542* (2013.01); *F05D 2220/32* (2013.01); *F05D 2240/12* (2013.01); *F05D 2240/30* (2013.01); *F05D 2240/55* (2013.01); *F05D 2240/80* (2013.01)

(58) Field of Classification Search
CPC ..... F01D 5/143; F01D 5/3007; F04D 29/324; F04D 19/02; F04D 29/542; F04D 29/384; F04D 29/388; F05B 2240/30; F05B 2240/124; F05B 2240/12; F05B 2240/80; F05B 2240/801; F05D 2240/30; F05D 2240/124; F05D 2240/12; F05D 2240/80; F05D 2240/81
USPC .... 415/193–194, 199.4–199.5, 209.1, 173.7; 416/198 R, 198 A, 200 R, 200 A, 201 R, 416/201 A, 193 A
See application file for complete search history.

(56) References Cited

U.S. PATENT DOCUMENTS 3,597,109 A * 8/1971 Petrie ..... F01D 5/30 416/193 A
3,937,592 A 2/1976 Bammert
4,507,052 A * 3/1985 Thompson ..... F01D 11/006 415/173.7
4,558,987 A 12/1985 Dittie
6,077,035 A * 6/2000 Walters ..... F01D 5/081 415/115
6,099,245 A 8/2000 Bunker
6,220,815 B1 * 4/2001 Rainous ..... F01D 11/001 415/174.5
7,238,008 B2 * 7/2007 Bobo ..... F01D 5/3015 416/220 R
2007/0297897 A1 12/2007 Tran et al.
2010/0158690 A1 * 6/2010 Cortequisse ..... B23K 1/0018 416/213 R
2013/0209259 A1 * 8/2013 Gomez ..... F01D 5/022 416/200 A

OTHER PUBLICATIONS

English Abstract/Translation for EP0043452A2—Jan. 13, 1982; 2 pgs.
European Search Report for Application No. 15190289.7-1610; dated Feb. 29, 2016; 5 pgs.

* cited by examiner

TANDEM ROTOR BLADES

CROSS REFERENCE TO RELATED APPLICATIONS

This application claims the benefit of U.S. Provisional Patent Application Ser. No. 62/064,536 filed Oct. 16, 2014, the entire contents of which are incorporated herein by reference thereto.

BACKGROUND

The present disclosure relates to rotor blades, such as rotor blades in gas turbine engines. Traditionally, gas turbine engines can include multiple stages of rotor blades and stator vanes to condition and guide fluid flow through the compressor and/or turbine sections. Stages in the high pressure compressor section can include alternating rotor blade stages and stator vane stages. Each vane in a stator vane stage can interface with a seal on the rotor disk, for example, a knife edge seal. The knife edge seals can be one source of increased temperature in the high-pressure compressor due to windage heat-up. Increased temperatures can reduce the durability of aerospace components, specifically those in the last stages of the high pressure compressor.

Such conventional methods and systems have generally been considered satisfactory for their intended purpose. However, there is still a need in the art for improved gas turbine engines.

BRIEF DESCRIPTION

A gas turbine engine includes a compressor section and a compressor case with a low pressure compressor (LPC) and a high pressure compressor (HPC). The HPC is aft of the LPC. The compressor case defines a centerline axis. The compressor section also includes a rotor disk defined between the compressor case and the centerline axis. A plurality of stages are defined radially inward relative to the compressor case. The plurality of stages includes at least one tandem blade stage. The tandem blade stage includes a plurality of blade pairs. Each blade pair is circumferentially spaced apart from the other blade pairs, and is operatively connected to the rotor disk. Each blade pair includes a forward blade and an aft blade. The aft blade is configured to further condition air flow with respect to the forward blade without an intervening stator vane stage shrouded cavity therebetween.

In certain embodiments, a leading edge of each aft blade can be defined forward of a trailing edge of a respective forward blade with respect to the centerline axis. The gas turbine engine can also include a plurality of circumferentially disposed blade platforms defined radially between the rotor disk and the blade pairs. Each blade pair can be integrally formed with a respective one of the blade platforms. The gas turbine engine can include an exit guide vane stage aft of the tandem blade stage. The exit guide vane stage can define the end of the compressor section.

In another aspect, the plurality of stages can include at least one forward stator vane stage forward of the tandem blade stage. The forward stator vane stage can include a plurality of circumferentially disposed stator vanes. Each stator vane can extend from a vane root to a vane tip along a respective vane axis and can be operatively connected to a forward shrouded cavity disposed radially between each respective vane root and the rotor disk. A forward knife edge seal can be between the rotor disk and an inner diameter surface of the forward shrouded cavity. The forward stator vane stage and the tandem blade stage can define the last two sequential stages before the exit guide vane stage.

It is contemplated that the gas turbine engine can include a tandem stator vane stage aft of the tandem blade stage. The tandem stator vane stage can include at least one stator vane pair extending radially between the compressor case and the centerline axis. Each stator vane pair can include a forward stator vane and an aft stator vane. A leading edge of each aft stator vane can be defined forward of a trailing edge of its respective forward stator vane with respect to the centerline axis. The tandem stator vane stage can define the end of the compressor section and the tandem blade stage and the tandem stator vane stage can define the last two sequential stages in the compressor section. In another aspect, a turbomachine can include a stator vane stage and a tandem blade stage aft of the stator vane stage, similar to stator vane and tandem blade stages described above.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION

Figure 1:
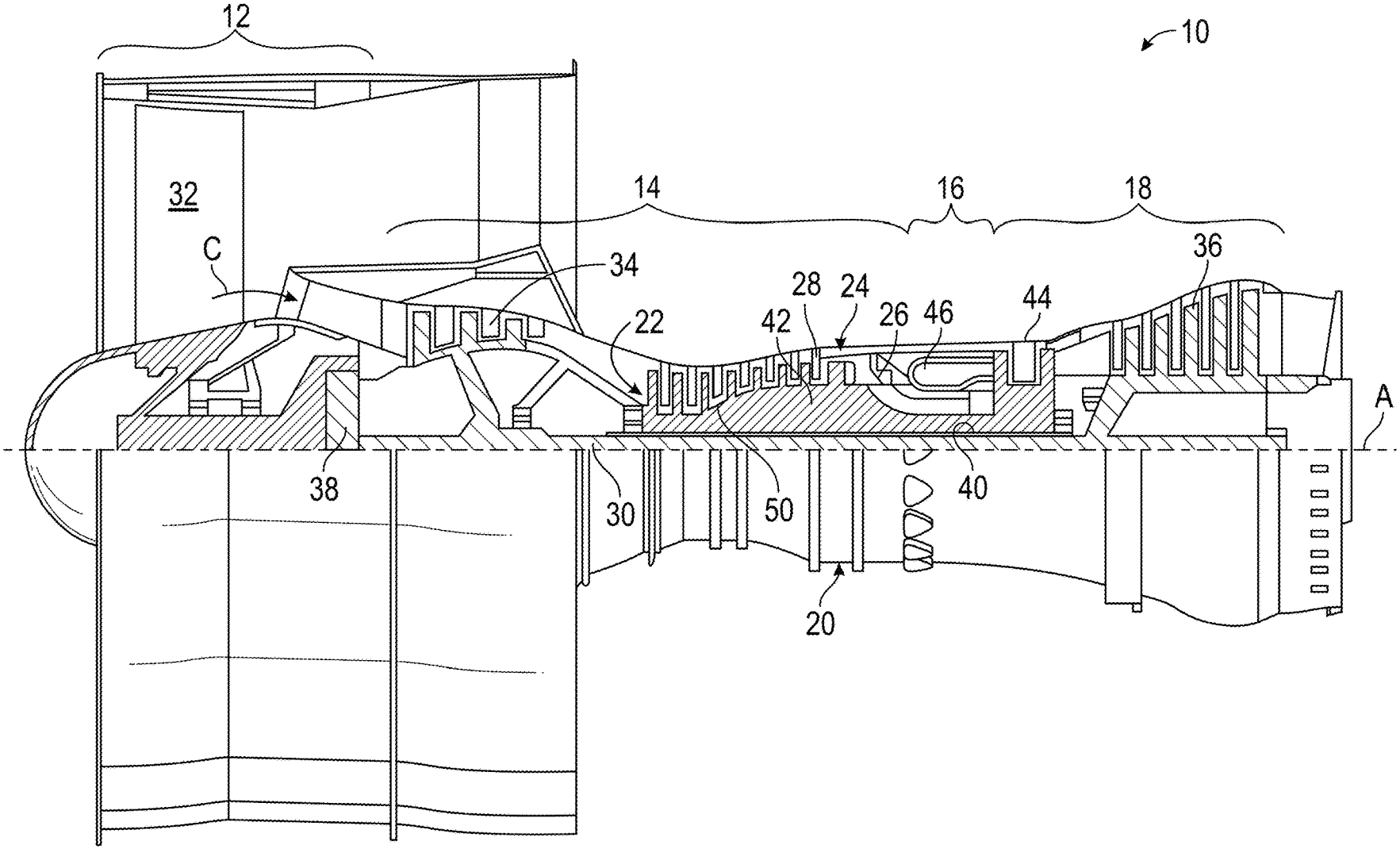
FIG. 1 is a schematic cross-sectional side elevation view of an exemplary embodiment of a gas turbine engine constructed in accordance with the present disclosure, showing a location of a tandem blade stage.

Reference will now be made to the drawings wherein like reference numerals identify similar structural features or aspects of the subject disclosure. For purposes of explanation and illustration, and not limitation, a cross-sectional view of an exemplary embodiment of the gas turbine engine constructed in accordance with the disclosure is shown in FIG. 1 and is designated generally by reference character 10. Other embodiments of gas turbine engines constructed in accordance with the disclosure, or aspects thereof, are provided in FIGS. 2-4, as will be described.

As shown in FIG. 1, a gas turbine engine 10 defines a centerline axis A and includes a fan section 12, a compressor section 14, a combustor section 16 and a turbine section 18. Gas turbine engine 10 also includes a case 20. Compressor section 14 drives air along a gas path C for compression and communication into the combustor section 16 then expansion through the turbine section 18. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

Gas turbine engine 10 also includes an inner shaft 30 that interconnects a fan 32, a LPC 34 and a low pressure turbine 36. Inner shaft 30 is connected to fan 32 through a speed change mechanism, which in exemplary gas turbine engine 10 is illustrated as a geared architecture 38. An outer shaft 40 interconnects a HPC 42 and high pressure turbine 44. A combustor 46 is arranged between HPC 42 and high pressure turbine 44. The core airflow is compressed by LPC 34 then HPC 42, mixed and burned with fuel in combustor 46, then expanded over the high pressure turbine 44 and low pressure turbine 36.

With continued reference to FIG. 1, HPC 42 is aft of LPC 34. Gas path C is defined in HPC 42 between the compressor case, e.g. engine case 20, and a rotor disk 50. A plurality of stages 22 are defined in gas path C. Plurality of stages 22 includes at least one tandem blade stage 24. Gas turbine engine 10 includes an exit guide vane stage 26 aft of tandem blade stage 24. Exit guide vane stage 26 defines the end of compressor section 14. At least one forward stator vane stage 28 is disposed forward of tandem blade stage 24. Forward stator vane stage 28 and tandem blade stage 24 define the last two sequential stages before exit guide vane stage 26. While embodiments of the tandem blade stage are described herein with respect to a gas turbine engine, those skilled in the art will readily appreciate that embodiments of the tandem blade stage can be used in a variety of turbomachines and in a variety of locations throughout a turbomachine, for example the tandem blade stage can be used in the fan, LPC, low pressure turbine and high pressure turbine.

Tandem blade stage 24 combines two, typically discrete, blade stages into a single stage. For example, a traditional compressor configuration generally has the last stages in the pattern of stator stage, rotor stage, stator stage, rotor stage, and exit guide vane stage. Embodiments described herein have the pattern of stator stage 28, tandem rotor stage 24, and exit guide vane stage 26 or a tandem stator stage, described below. Tandem rotor stage 24 does more work than a traditional single blade stage, providing additional pressure-ratio and also reducing the need for a traditional stator vane stage that typically separates two traditional single blade stages. By removing one of the stator vane stages, respective shrouded cavities that are typically associated with each vane in the stator vane stage, are no longer needed. Shrouded cavities tend to increase metal temperatures because of the interface between a seal, typically a knife edge seal, and the rotor disk. The increased temperatures at the knife edge seal cause increased overall temperatures as part of windage heat-up. By removing one of the shrouded cavities, the windage heat-up is reduced and temperatures of other engine components in the last stages of the HPC are also reduced.

Those skilled in the art will readily appreciate that by reducing the temperatures, the component life can be improved. For example, by removing the intervening stator vane stage and its knife edge seal, the remaining knife edge seals can be approximately ten to fifteen percent of compressor discharge temperature cooler than they would be if the traditional intervening stator stage and knife edge seal was included. Not only does this potentially increase the life of the remaining seals, it also increases the life of the surrounding engine components due to the reduced windage heat-up temperature. On the other hand, the overall operating temperatures can be increased in order to increase the pressure ratio while still remaining within the traditional temperature tolerances of the engine components. Reducing the need for a traditional stator vane stage by using a tandem blade stage also reduces the length of the compressor since gaps between stages can be removed, and/or tandem rotor blades can overlap each other in the axial direction.

Figure 2:
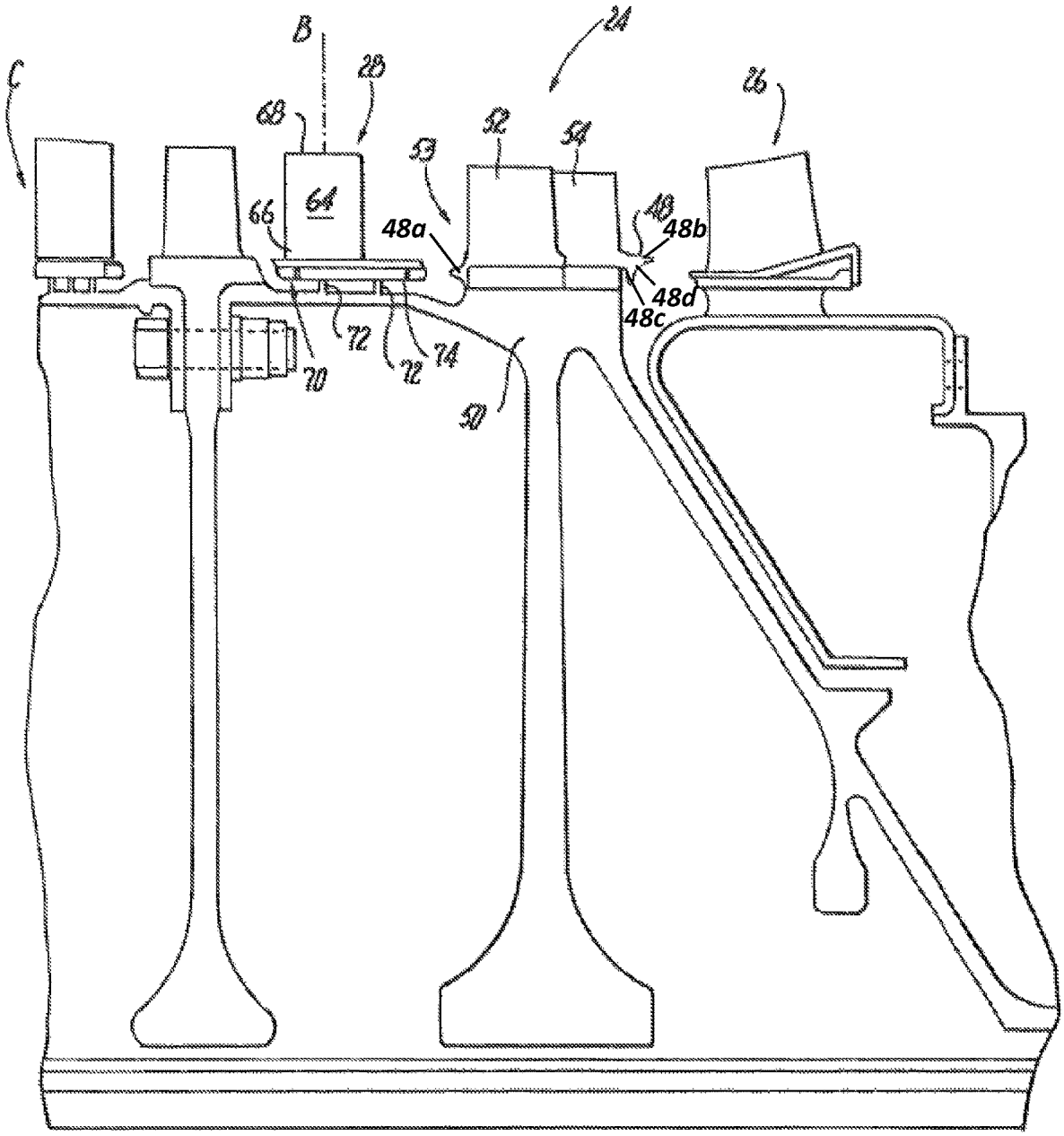
FIG. 2 is an enlarged schematic side elevation view of a portion of the gas turbine engine of FIG. 1, showing the last stages of the HPC with the tandem blade stage forward of an exit guide vane stage.
Figure 4:
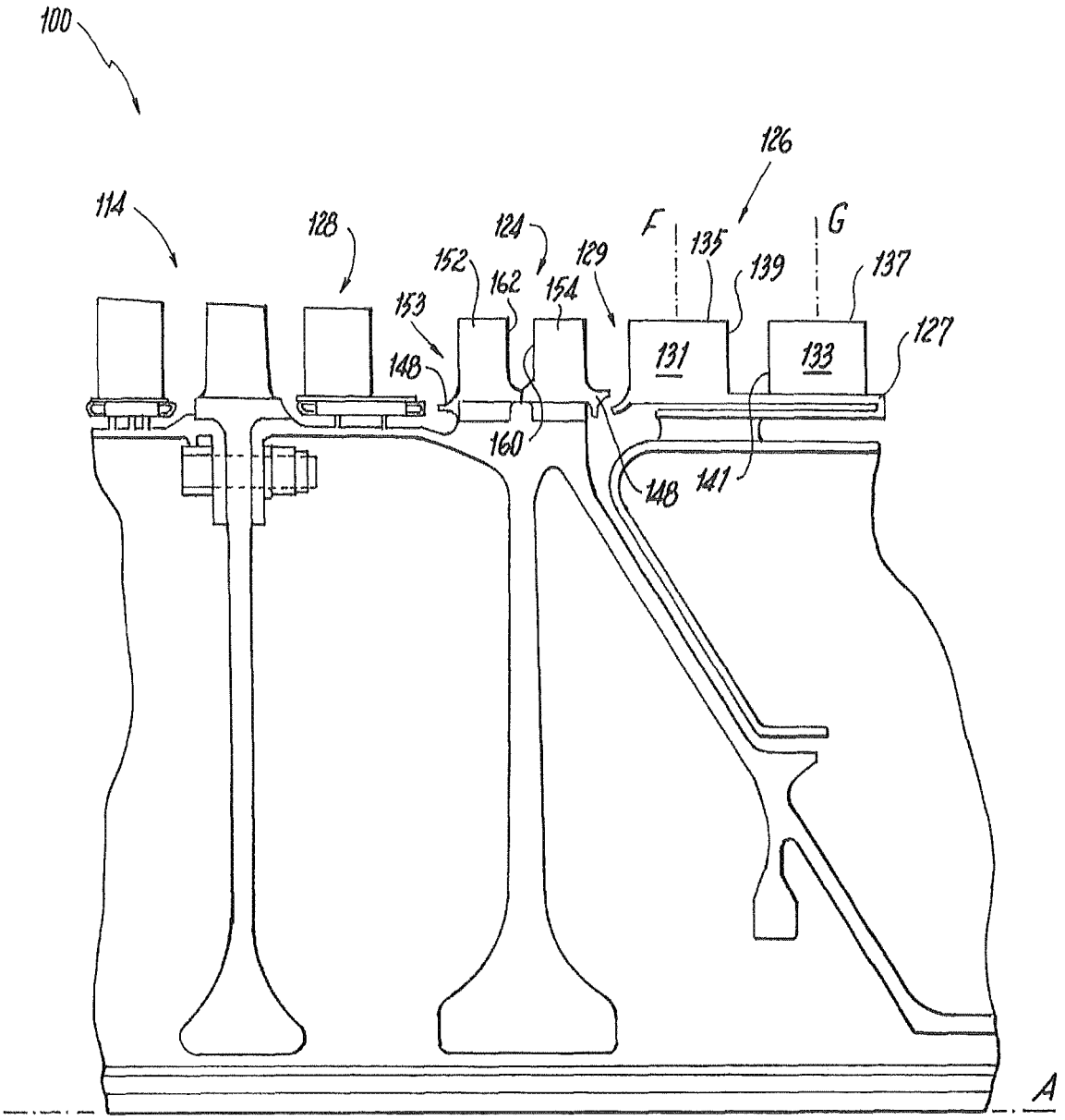
FIG. 4 is a schematic side elevation view of a portion of another exemplary embodiment of a gas turbine engine, showing the last stages of the HPC with the tandem blade stage forward of a tandem stator vane stage, where the blades of the tandem blade stage do not overlap one another.

As shown in FIG. 2, tandem blade stage 24 includes a plurality of circumferentially disposed blade platforms 48, each having a blade pair 53. Each blade platform 48 is operatively connected to rotor disk 50 disposed radially inward from blade platforms 48. A forward portion of each blade platform 48 includes a forward platform extension 48*a* that extends towards the stator vane stage 28. An aft portion of each blade platform 48 includes a first aft platform extension 48*b* and a second aft platform extension 48*c*. The first aft platform extension 48*b* extends towards the exit guide vane stage 26 or towards a tandem stator vane stage 126 having a stator vane pair 129 (as shown in FIG. 4). The second aft platform extension 48*c* is disposed transverse to the first aft platform extension 48*b* and is spaced apart from (i.e. does not engage) and extends towards the rotor disk 50. An arcuate surface 48*d* extends between the first aft platform extension 48*b* and the second aft platform extension 48*c*. Blade pair 53 extends radially from each of blade platforms 48 and includes a forward blade 52 and an aft blade 54. Those skilled in the art will readily appreciate that each blade pair 53 can be integrally formed with a respective one of blade platforms 48. While tandem blade stage 24 is described herein as having a plurality of blade platforms 48, each with a respective blade pair 53, those skilled in the art will readily appreciate that blade platforms 58 can include multiple blade pairs 53 on a single platform and/or a first blade platform can have forward blade 52 and a second blade platform directly aft of the first blade platform can have aft blade 54, similar to a blade pair 124 described below. Forward stator vane stage 28 includes a plurality of circumferentially disposed stator vanes 64. Each stator vane 64 extends from a vane root 66 to a blade tip 68 along a respective vane axis B and can be operatively connected to a shrouded cavity 70 disposed radially between vane root 66 and rotor disk 50. Knife edge seals 72 are between rotor disk 50 and an inner diameter surface 74 of shrouded cavity 70.

Figure 3:
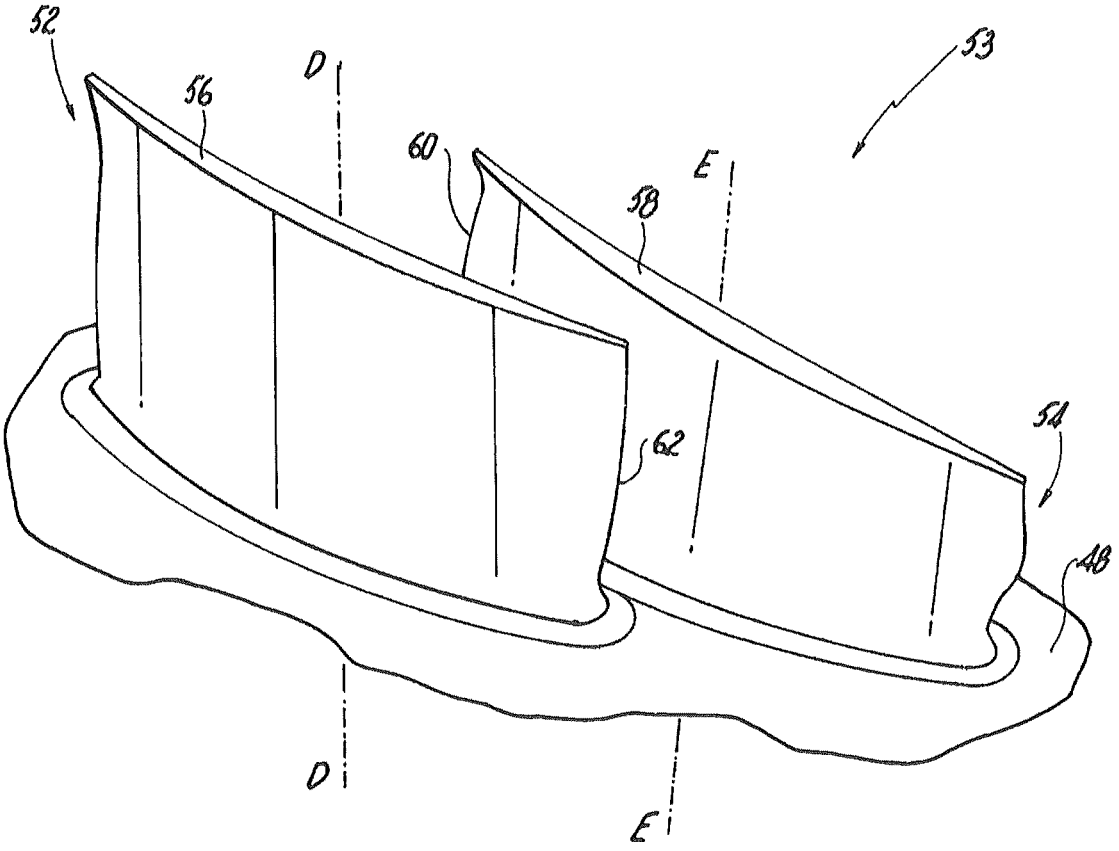
FIG. 3 is a top perspective view of an exemplary embodiment of a tandem blade constructed in accordance with the present disclosure, showing a forward blade and an aft blade.

As shown in FIG. 3, forward blade 52 extends radially from blade platform 48 to an opposed forward blade tip 56 along a forward blade axis D. Aft blade 54 extends radially from blade platform 48 to an opposed aft blade tip 58 along an aft blade axis E. Aft blade 54 further directs air flow without an intervening stator vane stage shrouded cavity, e.g. a shrouded cavity similar to shrouded cavity 70. A leading edge 60 of aft blade 54 is defined forward of a trailing edge 62 of forward blade 52 with respect to centerline axis A, shown in FIG. 1. Those skilled in the art will readily appreciate that forward blade 52 and aft blade 54 do not need to overlap one another, for example, it is contemplated that leading edge 60 of aft blade 54 can be defined aft of trailing edge 62 of forward blade 52, similar to tandem blade stage 124, described below.

Now with reference to FIG. 4, another embodiment of a gas turbine engine 100 is shown. Gas turbine engine 100 differs from gas turbine engine 10 in that gas turbine engine 100 has a tandem stator vane stage 126 aft of tandem blade stage 124, instead of having an exit guide vane stage, e.g. exit guide vane stage 26. Tandem stator vane stage 126 includes a vane platform 127 radially inward of a compressor case, e.g. compressor case 20, shown in FIG. 1. A stator vane pair 129 extends radially from vane platform 127. Stator vane pair 129 includes a forward stator vane 131 and an aft stator vane 133. Forward stator vane 131 extends radially from the vane platform to an opposed forward stator vane tip 135 along a forward stator vane axis F. Aft stator vane 133 extends radially from vane platform 127 to an opposed aft stator vane tip 137 along an aft stator vane axis G. A leading edge 141 of aft stator vane 133 does not axially overlap a trailing edge 139 of forward stator vane 131. However, those skilled in the art will readily appreciate that leading edge 141 of aft stator vane 133 can be defined forward of trailing edge 139 of forward stator vane 131, similar to tandem blade stage 24, described above. Tandem stator vane stage 126 defines the end of compressor section 114 and tandem blade stage 124 and the tandem stator vane stage 126 define the last two sequential stages in compressor section 114.

With continued reference to FIG. 4, gas turbine engine 100 also differs from gas turbine engine 10 in that a trailing edge 162 of forward blade 152 does not overlap a leading edge 160 of aft blade 154. Further, instead of a single blade platform, e.g. blade platform 48, each respective blade pair 124 includes a respective blade platform 148 for each of blades 152 and 154. Those skilled in the art will readily appreciate that a similar platform configuration can be utilized for tandem stator stage 126. It is also contemplated that that leading edge 160 of aft blade 154 can be defined forward of trailing edge 162 of forward blade 152, similar to tandem blade stage 24, described above.

The methods and systems of the present disclosure, as described above and shown in the drawings, provide for gas turbine engines with superior properties including improved control over fluid flow properties through the engine and reduced windage heat up. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A turbomachine comprising:

a stator vane stage; and a tandem blade stage aft of the stator vane stage, wherein the tandem blade stage includes:

a plurality of blade pairs, each of the plurality of blade pairs being circumferentially spaced apart from the other of the plurality of blade pairs, each blade pair being operatively connected to a rotor disk disposed radially inward from the plurality of blade pairs, wherein each of the plurality of blade pairs includes a forward blade and an aft blade, wherein the aft blade is configured to further condition air flow with respect to the forward blade without an intervening stator vane stage shrouded cavity therebetween, wherein each of the plurality of blade pairs is integrally formed with a blade platform that is defined radially between the rotor disk and a respective blade pair, a forward portion of the blade platform includes a forward platform extension that extends towards the stator vane stage and an aft portion of the blade platform includes a first aft platform extension that extends directly from one of the aft blades of the plurality of blade pairs toward an exit guide vane stage, a second aft platform extension that is disposed transverse to the first aft platform extension and is spaced apart from the rotor disk in a downstream direction and extends directly from the first aft platform extension toward the rotor disk, and an arcuate surface extending between the first aft platform extension and the second aft platform extension.

2. A turbomachine as recited in claim 1, wherein the exit guide vane stage is disposed aft of the tandem blade stage, wherein the exit guide vane stage defines an end of a compressor section.

3. A turbomachine as recited in claim 1, wherein a leading edge of each aft blade is defined forward of a trailing edge of a respective forward blade.

4. A turbomachine as recited in claim 1, wherein the stator vane stage includes a plurality of circumferentially disposed stator vanes, wherein each stator vane extends from a vane root to a vane tip along a respective vane axis, and wherein each stator vane is operatively connected to a forward shrouded cavity disposed radially between each respective vane root and the rotor disk.

5. A turbomachine as recited in claim 4, further comprising a forward knife edge seal between the rotor disk and an inner diameter surface of the forward shrouded cavity.

6. A turbomachine as recited in claim 1, wherein the stator vane stage and the tandem blade stage define the last two sequential stages before the exit guide vane stage, wherein the exit guide vane stage defines an end of a compressor section.

7. A gas turbine engine, comprising:

a compressor section including a low pressure compressor and a high pressure compressor, wherein the high pressure compressor is aft of the low pressure compressor, and wherein the compressor section includes a compressor case defining a centerline axis, and a rotor disk defined between the compressor case and the centerline axis; and a plurality of stages defined radially inward relative to the compressor case, wherein the plurality of stages includes at least one tandem blade stage, wherein the at least one tandem blade stage includes:

a plurality of blade pairs, each pair of the plurality of blade pairs being circumferentially spaced apart from the other blade pairs, each blade pair of the plurality of blade pairs including a forward blade and an aft blade, each blade pair of the plurality of blade pairs being operatively connected to the rotor disk, each blade pair of the plurality of blade pairs being integrally formed with a respective blade platform of a plurality of circumferentially disposed blade platforms, each blade platform including an aft portion having a first aft platform extension that extends directly from one of the aft blades of the plurality of blade pairs towards an exit guide vane stage, and a second aft platform extension extending directly from the first aft platform extension and is spaced apart from the rotor disk in a downstream direction and extends radially inward towards the rotor disk.

8. A gas turbine engine as recited in claim 7, wherein the exit guide vane stage is disposed aft of the tandem blade stage, wherein the exit guide vane stage defines an end of the compressor section.

9. A gas turbine engine as recited in claim 7, wherein a leading edge of each aft blade is defined forward of a trailing edge of a respective forward blade with respect to the centerline axis.

10. A gas turbine engine as recited in claim 7, wherein the plurality of circumferentially disposed blade platforms are defined radially between the rotor disk and the blade pairs.

11. A gas turbine engine as recited in claim 7, wherein the plurality of stages includes at least one forward stator vane stage forward of the tandem blade stage, wherein the at least one forward stator vane stage includes a plurality of circumferentially disposed stator vanes, wherein each stator vane extends from a vane root to a vane tip along a respective vane axis, and wherein each stator vane is operatively connected to a forward shrouded cavity disposed radially between each respective vane root and the rotor disk.

12. A gas turbine engine as recited in claim 11, further comprising a forward knife edge seal between the rotor disk and an inner diameter surface of the forward shrouded cavity.

13. A gas turbine engine as recited in claim 11, wherein the at least one forward stator vane stage and the tandem blade stage define the last two sequential stages before the exit guide vane stage, wherein the exit guide vane stage defines an end of the compressor section.

14. A gas turbine engine as recited in claim 7, wherein a leading edge of each aft stator vane is defined forward of a trailing edge of its respective forward stator vane with respect to the centerline axis.

* * * * *